US010974086B2

(12) United States Patent
Nessel et al.

(10) Patent No.: US 10,974,086 B2
(45) Date of Patent: Apr. 13, 2021

(54) LID AND TROLLEY SYSTEM FOR USE WITH FIRE TEST PAN

(71) Applicant: Rusoh, Inc., Eau Claire, WI (US)

(72) Inventors: Kimberly Robert Nessel, Altoona, WI (US); Terry Etheridge, Eau Claire, WI (US)

(73) Assignee: Rusoh, Inc., Eau Claire, WI (US)

( * ) Notice: Subject to any disclaimer, the term of this patent is extended or adjusted under 35 U.S.C. 154(b) by 1064 days.

(21) Appl. No.: 15/385,140

(22) Filed: Dec. 20, 2016

(65) Prior Publication Data

US 2018/0169452 A1 Jun. 21, 2018

(51) Int. Cl.

| | |
|---|---|
| ***A62C 3/00*** | (2006.01) |
| ***A62C 99/00*** | (2010.01) |
| *A62C 3/02* | (2006.01) |

(52) U.S. Cl.

CPC ..... *A62C 99/0081* (2013.01); *A62C 3/00* (2013.01); *A62C 3/0257* (2013.01)

(58) Field of Classification Search

CPC ..... A62C 99/0009; A62C 99/009; A62C 99/0018; A62C 99/0081; A62C 3/0257; A62C 8/06

See application file for complete search history.

(56) References Cited

U.S. PATENT DOCUMENTS 1,951,798 A * 3/1934 Lawson ..... A62C 8/06 169/50
4,061,333 A * 12/1977 Shaps ..... A63B 51/12 473/534
4,249,067 A * 2/1981 Cummings ..... A63H 33/3055 219/392
4,541,768 A * 9/1985 Walker ..... B64F 1/32 193/35 MD (Continued)

FOREIGN PATENT DOCUMENTS

JP 61-063248 U 4/1986
JP 61063248 U * 4/1986

(Continued)

OTHER PUBLICATIONS

"International Application Serial No. PCT/US2017/067045, International Search Report dated Apr. 10, 2018", 3 pgs.

(Continued)

*Primary Examiner* — James B Hull
*Assistant Examiner* — Jennifer L Korb

(57) ABSTRACT

Systems, devices, and methods are described herein for extinguishing fires in a flammable liquid test pan. In an example, the system can include a substantially impermeable lid configured to mate with a top surface of the test pan. When the lid is mated with the test pan, the lid deprives an enclosed volume of the test pan of ambient combustible gas. The lid can be made of one or more materials including metals, ceramics, aramid fibers, and other gas-impermeable (Continued)

and fire resistant materials. The system can include a vehicle configured to carry the lid from a first location that is distal to the test pan to a second location that is adjacent to the test pan. In an example, the vehicle includes a lid transfer device that facilitates transferring the lid from the vehicle to the top surface of the test pan.

16 Claims, 8 Drawing Sheets

(56) References Cited

U.S. PATENT DOCUMENTS

| | | | | | |
|---|---|---|---|---|---|
| 5,842,525 | A | * | 12/1998 | Graham | A62C 8/06 169/50 |
| 5,938,262 | A | * | 8/1999 | Mills | B62D 33/08 296/26.09 |
| 6,114,003 | A | * | 9/2000 | Gottfried | B32B 15/04 428/73 |
| 6,161,348 | A | | 12/2000 | Morris | |
| 2016/0137215 | A1 | | 5/2016 | Ondrasik | |
| 2016/0214634 | A1 | | 7/2016 | Palma | |

FOREIGN PATENT DOCUMENTS

| | | | |
|---|---|---|---|
| KR | 10-1405473 | B1 | 6/2014 |
| WO | WO-2016/149408 | A1 | 9/2016 |

OTHER PUBLICATIONS

"International Application Serial No. PCT/US2017/067045, Written Opinion dated Apr. 10, 2018", 11 pgs.

* cited by examiner

LID AND TROLLEY SYSTEM FOR USE WITH FIRE TEST PAN

BACKGROUND

Fire extinguisher agents are rigorously tested for efficacy and efficiency. A standard test system for fire extinguisher agents includes a fire test pan in an enclosed or outdoor environment. Fire test pans vary in size and shape, but most are rectangular and hold multiple gallons of liquid fuel. The fuel can be heptane or another flammable liquid. The test pan is filled with an appropriate flammable fuel, the fuel is ignited, and then a fire extinguisher agent to be tested is used to attempt to extinguish the fire. Typically, metered or specified amounts of an extinguisher agent are applied for a given test.

In some examples, a fire extinguisher agent under test may be insufficient to fully extinguish a test fire burning in a fire test pan. Test personnel must then use additional extinguisher material of the same or a different type to fully extinguish the fire. Thus the fire test pan and the fuel within can become contaminated with the excess extinguisher agent. Test personnel may be deterred from performing multiple tests because extinguisher agents can be expensive, such as those agents that are used to extinguish a fire remaining after a test agent is dispensed. In addition, it can be time consuming and inefficient to clean fire test pans that are contaminated with extinguisher agents.

SUMMARY

The present inventors have recognized that a problem to be solved includes reducing an amount of extinguisher agent used or applied during a fire test event. Reducing an amount of extinguisher agent used reduces testing costs and maintains purity or cleanliness of a fuel or other material in the fire test pan. The present inventors have recognized that a further problem to be solved includes reducing a time between test events, such as by reducing or eliminating a need to strain or filter extinguisher agent from test pan fuel between tests. The present inventors have recognized that a further problem to be solved includes extinguishing a test fire in a fire test pan completely and quickly. The present inventors have recognized that a further problem to be solved includes maintaining a free or open area in the vicinity of a fire test pan while a fire test event occurs, such as to reduce an influence of environmental factors on a fire test event and thereby improve reproducibility.

A solution to at least these problems includes using a fire test pan lid and a trolley system configured to deliver the fire test pan lid to the fire test pan. In an example, the system includes a substantially impermeable lid configured to mate with a top surface of a flammable liquid test pan. When the lid engages and is mated with the test pan, the lid deprives an enclosed volume of the test pan of combustible gas, such as oxygen, present in the environment near the test pan. The lid construction includes, but is not limited to, metals, ceramics, aramid fibers, and other gas-impermeable and fire-resistant materials.

In an example, the system includes a vehicle configured to carry the lid from a first location distal to the test pan to a second location adjacent to the test pan. In an example, the vehicle includes a lid transfer device that facilitates transferring the lid from the vehicle to the top surface of the test pan. In an example, the vehicle includes an adjustable height deck to accommodate different test pan heights, and to accommodate different types of test pan lids (e.g., shapes, configurations or the like).

In an example, the test pan lid includes a flexible material such as a aramid fiber reinforced fire blanket or other fire resistant material. The flexible material is configured to conform to an upper edge surface of a fire test pan to provide a substantially airtight seal and thereby deprive an enclosed volume of oxygen or other combustible gas.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
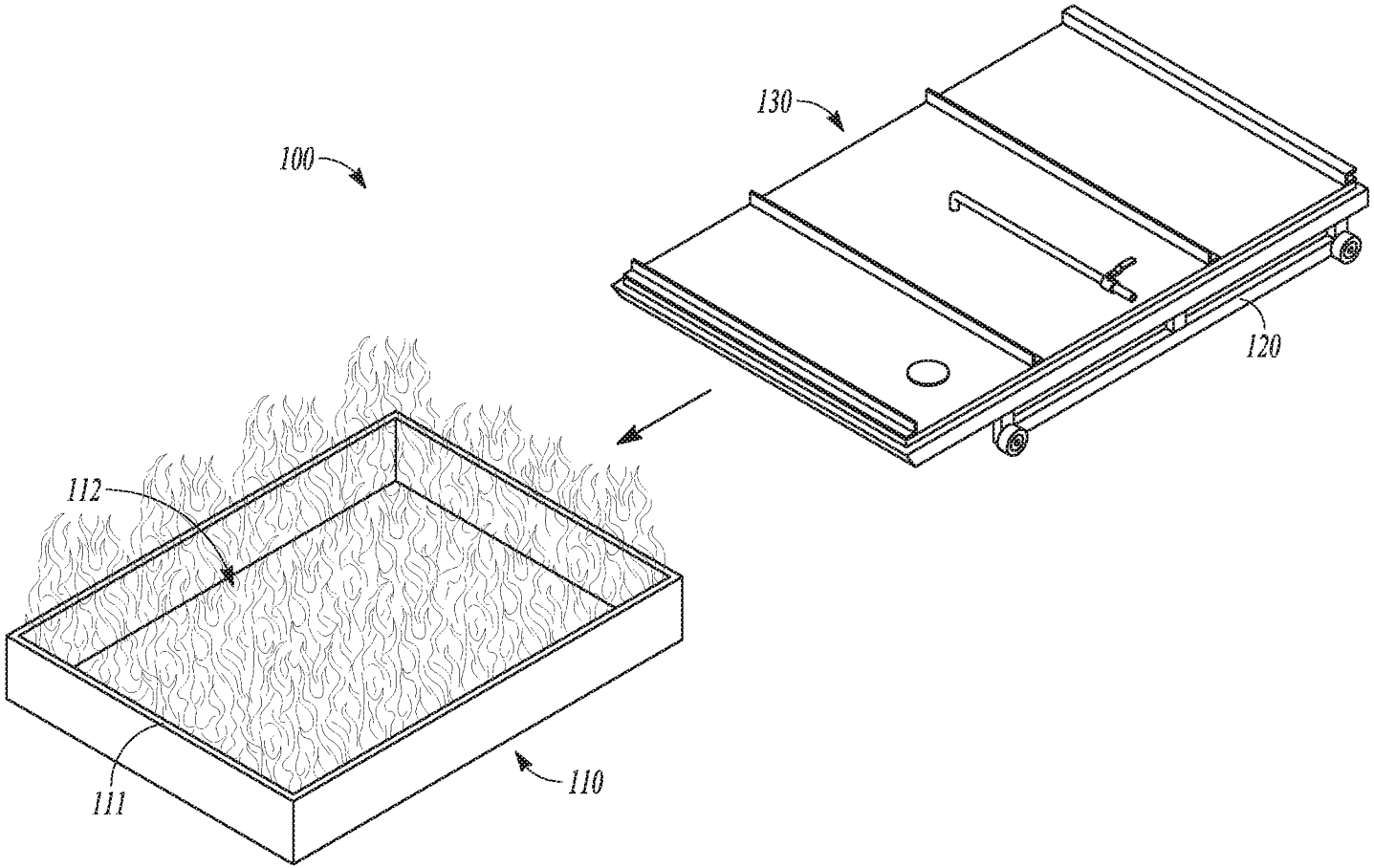
FIG. 1 illustrates generally an example of a fire extinguishing system and a flammable liquid test pan.

FIG. 1 illustrates generally an example of a fire extinguishing system 100 and a flammable liquid test pan 110. The test pan 110 includes an open-top container with three or more sidewalls and is configured to hold a flammable liquid fuel 112. The liquid fuel 112 is ignited and used as a target for various fire extinguisher tests or fire safety exercises. In some examples, the flammable liquid fuel 112 in the test pan 110 is heptane. The test pan 110 is constructed with one or more materials including various heat-resistant and fire-resistant materials including, but not limited to, metal, ceramic, or other materials that can withstand high heat and high magnitude temperature fluctuations over many cycles.

The test pan 110 can be positioned on a floor or ground surface. Optionally, the test pan 110 is elevated by a stand or pedestal. A clear area is generally maintained around the sides and above the test pan 110 to limit obstructions and minimize the influence of the airflow around the test pan 110. In an example, the test pan 110 is recessed into the ground.

Fire extinguisher materials are used or consumed over the course of a fire extinguisher test to extinguish a test fire in the test pan 110. In some examples, at least a portion of the extinguisher materials used in a given test remain in the test pan 110 after a test is completed, such as after a test fire is extinguished. The remaining extinguisher materials include the extinguisher material under test, and optionally other extinguisher materials used to more quickly or more completely extinguish a test fire after the effects of an extinguisher material under examination were observed. For example, in addition to an extinguisher material under test, an additional extinguisher agent such as a potassium bicarbonate-based extinguisher like PKP or Purple-K is used. In some examples, the various extinguisher materials contaminate any remaining flammable liquid fuel 112 in the test pan 110. In some cases, the remaining flammable liquid fuel 112 remains usable (e.g., capable of reignition) and is used for subsequent tests, or the remaining flammable liquid fuel 112 is optionally cleaned to remove at least some of the extinguisher material from a prior test. However, cleaning of a test pan is a time consuming and labor intensive process, and reignition characteristics of the remaining fuel is difficult to predict.

Where cleaning is available, some powder-based extinguisher agent accumulates on a surface of the flammable liquid fuel 112, and the extinguisher agent is skimmed off to improve the quality of any remaining flammable liquid fuel 112. However, in some examples at least a portion of the extinguisher agent sinks or dissolves in the fuel, and accumulates to unacceptable levels over multiple tests. Accumulated extinguisher agent in the test pan 110 deflects fire and heat up or away from the test pan 110, in some instances, and these events influence the characteristics of a test fire and the behavior of an extinguisher agent under examination. In addition, undesirable or toxic byproducts of consumed or partially consumed fire extinguisher material are sometimes left behind in the test pan 110 after use. Furthermore, in some cases, extinguishing agents can react violently when mixed with other dissimilar agents increasing the risk of flammability, hotter fires, or toxic gases.

In addition to the difficulty of removing used fire extinguisher materials from the test pan 110, fire extinguisher materials are often one or more of expensive or difficult to manufacture. Thus, a problem to be solved includes minimizing an amount of fire extinguisher material that is used in a given test event. The present inventors have recognized that a solution to the problem includes using the fire extinguishing system 100 to extinguish a fire in the test pan 110, for instance without the use of additional chemical extinguisher materials (or optionally with a limited addition of materials).

The fire extinguishing system 100 includes, in an example, a first vehicle 120 configured to carry a first lid 130. The first lid 130 can include a substantially impermeable surface that is configured to mate with, or seat against, a top edge 111 or top surface of the test pan 110. When the first lid 130 is positioned atop the test pan 110, the lid deprives an enclosed volume of the test pan 110 (e.g., enclosed by the lid and optionally side walls and a bottom of the test pan 110) of any combustible gases, thereby extinguishing any fire within. In an example, the test pan 110 includes a one-inch width or greater flat surface around a top perimeter edge of the test pan 110, corresponding to the top edge 111. The first lid 130 is positioned against this flat surface to form an airtight seal (e.g., including airtight, substantially airtight, or air constrictive seal). Even if the seal is imperfect, a fire in the test pan 110 is extinguished as long as a volume of combustible gas (e.g., oxygen) drawn Through the imperfect seal is insufficient to maintain the test fire.

The first vehicle 120 is movable and configured to carry the first lid 130 from a first location distal to the test pan 110 to a second location near or adjacent to the test pan 110. When the first vehicle 120 is positioned at the second location near or adjacent to the test pan 110, the first lid 130 can be manually or automatically moved from the first vehicle 120 to a seated position atop the test pan 110 to deprive an interior volume of the test pan 110 of combustible gas. The first lid 130 is optionally configured for use with any size test pan. In an example, the first lid 130 is configured to fit over a pan that is size "20B", corresponding to a 50 square foot test area, or smaller. Larger and smaller lids are similarly configured to fit with one or more correspondingly sized (or smaller) pans.

The fire extinguishing system 100 facilitates the extinguishing of test fires and reduces test costs by minimizing an amount of extinguishing agent used to carry out tests. Further, by minimizing the use of other extinguishing materials (e.g., to extinguish fires after testing) the flammable liquid fuel 112 in the test pan 110 is kept relatively clean and pure. In addition, using the fire extinguishing system 100 reduces downtime between fire test events because the clean and pure fuel in the test pan 110 does not require straining or other cleaning to separate excess spent extinguishing agent from fuel that remains in the pan.

Figure 2:
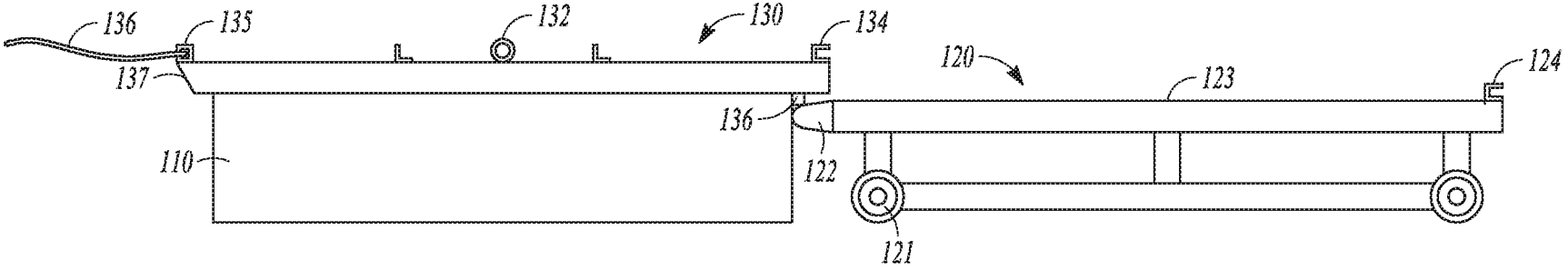
FIG. 2 illustrates generally a side view of a system that includes a flammable liquid test pan, a first test pan lid, and a first vehicle configured to carry the first test pan lid.

FIG. 2 illustrates generally a side view of the fire extinguishing system 100, including the flammable liquid test pan 110, the first lid 130, and the first vehicle 120 configured to carry the first lid 130. In the example of FIG. 2, the first vehicle 120 is illustrated at a position adjacent to the test pan 110, and the first lid 130 is illustrated in a seated position atop the test pan 110.

In an example, the first vehicle 120 is constructed of a durable, heat resistant and flame resistant frame material such as steel or aluminum. In an example, the first vehicle 120 includes several wheels 121 (e.g., rollers or casters) to facilitate movement of the first vehicle 120 relative to the ground. Alternatively or additionally to the wheels 121, the first vehicle 120 can include a sleigh with runners (see, e.g., FIG. 6) or some other arrangement of features to reduce friction between the vehicle and a surface upon which or over which the vehicle is to travel. In an example, the first vehicle 120 is configured to travel in a track that extends from the test pan 110 to a remote location (see, e.g., FIG. 4 at track 240).

The first vehicle 120 includes a top surface 123 that can have various surface characteristics. The top surface 123 is generally configured to carry the first lid 130, and can optionally include one or more features to secure the first lid 130 to the first vehicle 120. In an example, the first vehicle 120 includes a push rod receptacle 124 at or near a rear edge of the first vehicle 120, The push rod receptacle 124 can be configured to receive a push rod that can be used to move the first vehicle 120 between various locations, such as with or without the first lid 130. In an example, the push rod receptacle 124 is configured to receive a pike pole. In an example, the push rod receptacle 124 also serves as a stopper that prevents the first lid 130 from moving or sliding off of a rear side edge of the first vehicle 120. Various other stoppers (see, e.g., the vehicle lid stop 226 in the example of FIG. 4) can be provided at the front, rear, or side edges of the first vehicle 120 to further support or secure the first lid 130.

In an example, the first vehicle 120 includes a vehicle bumper 122. The vehicle bumper 122 can be made of a heat resistant rubber, metal, or other material, and can be configured to impinge on a side edge or side surface of the test pan 110 when the first vehicle 120 is moved into position adjacent to the test pan 110. Once the vehicle bumper 122 contacts the test pan 110, the first lid 130 can be removed from the vehicle and placed on top of the test pan 110.

Figure 3:
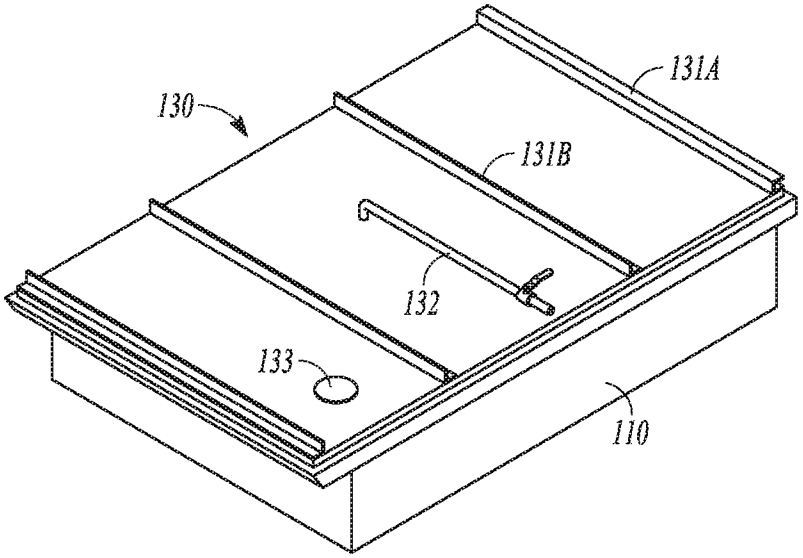
FIG. 3 illustrates generally a perspective view of a flammable liquid test pan covered by a first test pan lid.

Various features of the first lid 130 are illustrated generally in FIG. 2 and FIG. 3. FIG. 3 illustrates a perspective view of the flammable liquid test pan 110 covered by the first lid 130 in which several features are more visible. In an example, the first lid 130 is constructed in part using a sheet of 14 gauge or greater steel. Generally, a lower surface material of the first lid 130 is selected to be smooth, and support members can be provided on an upper surface to maintain flatness of the first lid 130.

Over the course of multiple tests, the lid is subjected to drastic temperature swings that can cause some materials to warp or deform. For instance, heat distortion can warp the first lid 130, which can lead to gaps or airspaces between the lower surface of the first lid 130 and the test pan 110, and oxygen could enter the burn area through such gaps or airspaces. To help prevent the lid from warping, the first lid 130 in the examples of FIGS. 2 and 3 includes multiple support members 131A and 131B. The support members 131A and 131B can be provided across an upper or lower surface of the lid to reinforce and maintain structural integrity of the first lid 130. The support members 131A and 131B can include, among other things, cross bars, ribs, or other elements that span all or a portion of the lid surface to help maintain the lid in a substantially flat or otherwise desired configuration.

Various access ports can be provided in the first lid 130 to provide gas or fluid communication between upper and lower sides of the first lid 130. In an example, after mating the first lid 130 with the test pan 110, it can be necessary or desirable to introduce a further fire extinguisher agent to the enclosed volume of the fire test pan 110, such as to more quickly extinguish a test fire than could be accomplished by the first lid 130 alone. In an example, the first lid 130 includes a through-hole access port 133 with a closable cover. The access port 133 can be sized or configured to allow a fire extinguisher agent to be introduced to the enclosed volume of the test pan 110 when the first lid 130 is mated with the test pan 110. The access port 133 can include a door that can be mounted on a swivel or pivot such that the access port 133 is normally closed. When the access portion 133 is closed, it can provide a substantially airtight seal to prevent oxygen from entering the test pan 110. In an example, the access port 133 is located near an outer edge of the first lid 130 so that the access portion 133 is easily accessed by test personnel standing adjacent to the test pan 110.

In an example, the first lid 130 can additionally or alternatively include a gas inlet 132 coupled to a conduit or pipe and that provides gas communication between the enclosed volume and a remote gas source. The gas source can be configured to provide an aerosol fire extinguisher agent or other gas, such as nitrogen or carbon dioxide, directly into the enclosed volume. The gas inlet 132 or conduit can include one or more valves to meter the release of any gases into the enclosed volume.

In an example, the first lid 130 can be transferred from the first vehicle 120 to the top of the fire test pan 110 manually or automatically. The first lid 130 and/or first vehicle 120 can include various features such that test personnel can manually transfer the lid from the vehicle and yet still maintain a safe distance from any fire that may be burning in the fire test pan 110. For example, the first lid 130 can include a push plate 134 secured to the first lid 130 and configured to receive a push rod, pike pole, or other pushing device. In an example, the push plate 134 includes a reinforced area configured to receive a force over a small area and transfer that force to the first lid 130 to thereby move the first lid 130 from the surface or deck of the first vehicle 120 and/or from the top edge 111 of the test pan 110. In an example, the first lid includes a lid handle 135. The lid handle 135 can be manually grabbed or pulled by test personnel, or can be coupled to a tool or cable. For example, a fire-resistant cable 136 can be coupled to the first lid 130, and the cable 136 can be pulled by a user or device (e.g., a winch) to transfer the lid from the first vehicle 120 to the top surface of the test pan 110.

In an example, the first lid 130 includes other features that can help further facilitate transfer of the lid to the top surface of the test pan 110. The first lid 130 can include a chamfered or rounded leading edge 137. The leading edge 137 can help guide the first lid 130 over the top edge 111 of the test pan 110 if there is a height mismatch with the top surface of the first vehicle 120.

Figure 4:
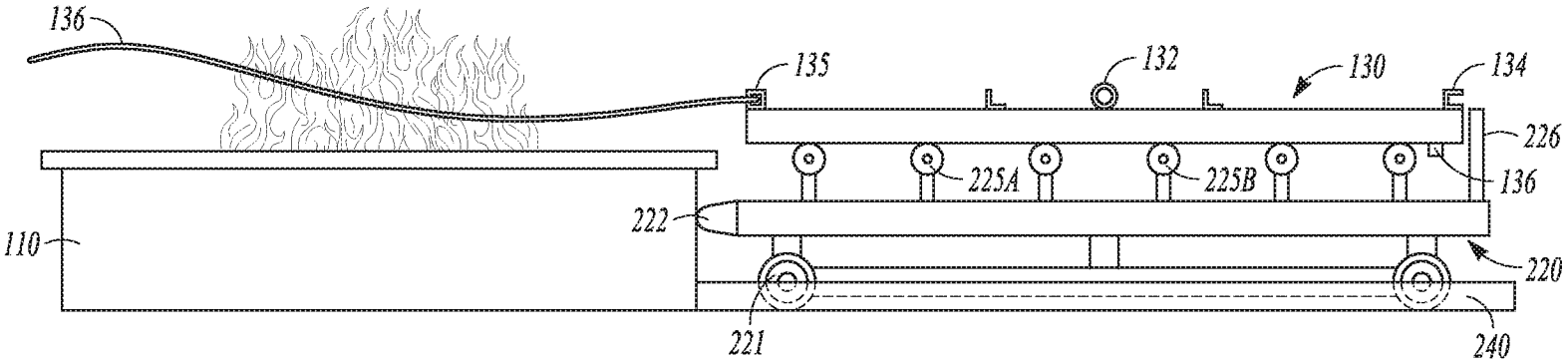
FIG. 4 illustrates generally a side view of a system that includes a flammable liquid test pan, the first lid, and a second vehicle configured to carry the first lid.

FIG. 4 illustrates generally a side view of a system that includes the flammable liquid test pan 110, the first lid 130, and a second vehicle 220 configured to carry the first lid 130. The second vehicle 220 includes an upper surface with multiple rollers 225A and 225B. The rollers 225A, 225B can include cylindrical conveyor rollers configured to carry distributed loads. The rollers can help test personnel to transfer the first lid 130 from the second vehicle 220 to the test pan 110, or to transfer the first lid 130 from the test pan 110 to the second vehicle 220. The rollers 225A, 225B can be positioned such that a bottom surface of the first lid 130 rests on a top surface of the rollers. When the lid is pushed from one side with sufficient force, the rollers can roll to facilitate movement of the lid. Additionally or alternatively to rollers, the vehicle can include a sleigh or track system to facilitate movement of the lid relative to the vehicle, as shown in the other example vehicles described herein. Additionally or alternatively, the vehicle can include a top surface or deck with one or more ball transfer casters sometimes referred to as a ball table or ball deck).

In the example of FIG. 4, the second vehicle 220 further includes a vehicle lid stop 226. The vehicle lid stop 226 can help prevent the first lid 130 from sliding or moving beyond a designated top surface portion of the second vehicle 220.

In an example, the second vehicle 220 includes wheels 221 to facilitate movement of the second vehicle 220 relative to a ground or travel surface. The second vehicle 220 can further include a front bumper 222 to help dampen impacts with a side wall of the test pan 110.

In an example, the second vehicle 220 is configured to travel on or in a track 240. That is, the wheels 221 of the second vehicle 220 can be configured to be received in the track 240, and the track 240 can help to guide the second vehicle 220 from a first location that is distal to the test pan 110 to a second location that is proximal or adjacent to the test pan 110. One or more automated drive features can be provided or used to convey the second vehicle 220 between the first and second locations. In an example, a wheel push or roller dolly system can be used in the track (e.g., similar to a wheel push system in an automated car wash) to drive the second vehicle 220. Additionally or alternatively, the second vehicle 220 can be manually pushed or pulled by test personnel along the track 240 between the first and second locations. Generally, the design and implementation of the track 240 is selected to minimize the track's influence on ambient airflow at or around the test pan 110, and to minimize the track's influence on heat transfer to or from the test pan 110.

Figure 5:
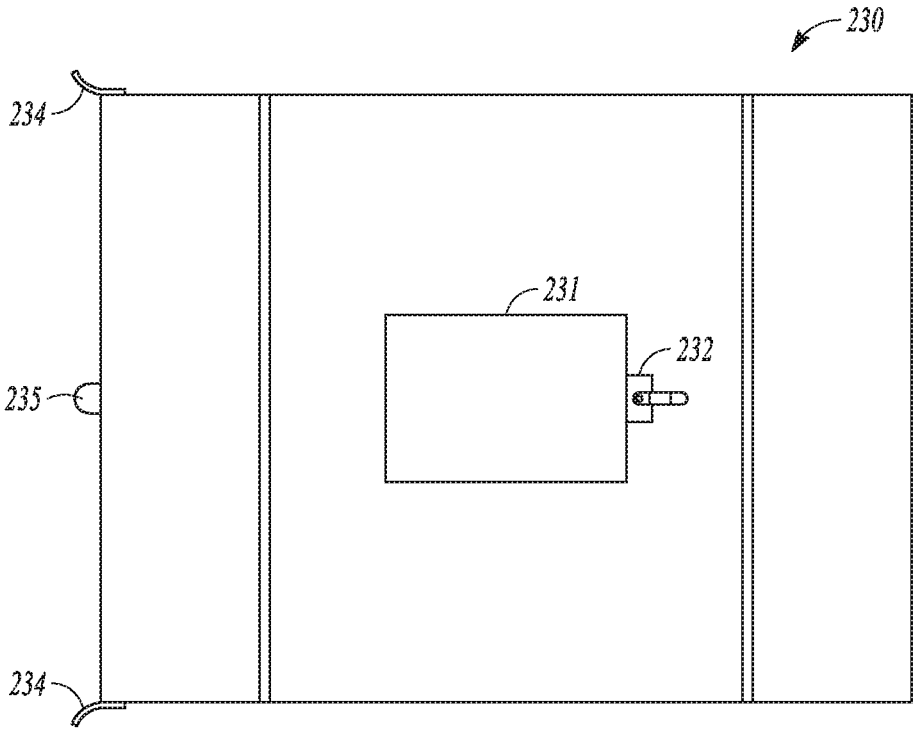
FIG. 5 illustrates generally a top view of a second lid with an extinguisher material container.

FIG. 5 illustrates generally a top view of a second Rd 230 with an extinguisher material container 231. The various features of the second lid 230 can optionally be combined with the features of the first lid 130 and vice versa. In an example, the second lid 230 includes the container 231 on the lid's top surface. The container 231 can include or hold dry ice (solid carbon dioxide) or other coolant or fire extinguisher material. The container 231 can include a gas passage from an interior of the container to a volume enclosed by the bottom surface of the second lid 230 and the test pan 110 when the second lid 230 is mated with the test pan 110. The gas passage between an interior of the container 231 and the bottom surface of the second lid 230 can be opened or closed by a container actuator 232. The actuator 232 can be manually toggled by test personnel or can be toggled remotely using an automated actuator device.

In an example, the container 231 can be loaded with dry ice or other material before a fire test event is carried out. After the test event is initiated, the second lid 230 can be moved into position and mated with a top surface of the test pan 110. When the second lid 230 is partially or fully mated with the top surface of the test pan 110, the actuator 232 can be toggled to release the contents of the container 231 into the test pan 110 below the second lid 230 to thereby use the contents of the container 231 to help extinguish the test fire or to help cool the test pan 110 or the fuel within the test pan 110.

In the example of FIG. 5, the second lid 230 includes a handle 235 that is configured similarly to the handle 135 in the example of the first lid 130. In an example, the second lid 230 includes front edge guides 234. The guides 234 can help center the second lid 230 with respect to the test pan 110 when the second lid 230 approaches the test pan 110. In an example, the guides 234 include durable, heat resistant members that extend at an angle away from a front edge surface of the second lid 230. If there is an alignment error or mismatch in the approach of the second lid 230 to the test pan 110, then the guides 234 can help correct the error and improve alignment of the second lid 230 and the test pan 110.

Figure 6:
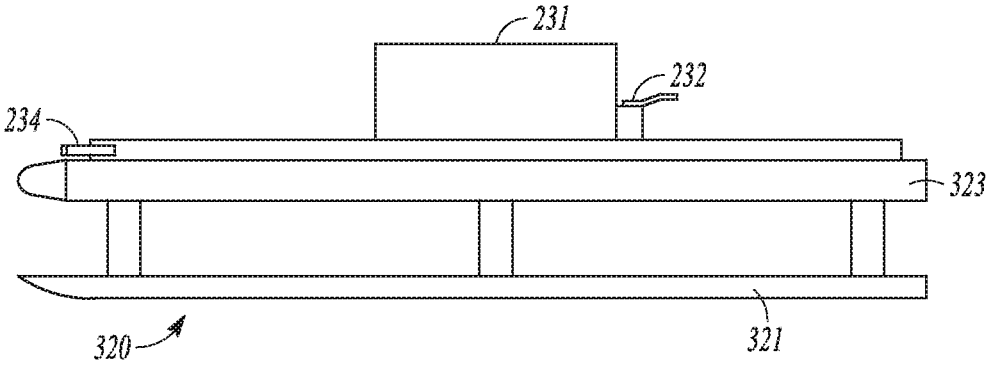
FIG. 6 illustrates generally a side view of a system that includes the second lid and a third vehicle configured to carry the second lid.

FIG. 6 illustrates generally a side view of a system that includes the second lid 230 and a third vehicle 320 configured to carry the second lid 230. The third vehicle 320 is non-wheeled, however wheels can optionally be incorporated into the example vehicle. The third vehicle 320 includes at least two sleigh runners 321 that help the third vehicle 320 slide along a floor or track system. The third vehicle 320 includes a top surface 323 configured to carry a lid, such as the second lid 230. One or more rollers can optionally be incorporated into the example to help facilitate movement of the second lid 230 relative to the top surface 323 of the third vehicle 320.

Alternatively to the rigid lids provided in the examples of FIGS. 1-6, the lids can include or use a flexible material such as a fire-resistant fabric, aramid fibers, or fiberglass, among others. The examples of FIGS. 7-13 illustrate generally lids that include or use a fire blanket or flexible aluminized material. The examples of FIGS. 7-13 generally resemble a trampoline-like lid configuration wherein a flexible lid material is extended between and supported by springs attached to a perimeter frame. The examples of lids in FIGS. 7-9, 12, and 13 can be used with any of the first, second, and third vehicles 130, 230, and 330. Other vehicles, pulley systems, rollers, conveyors, and devices can similarly be used to convey or carry the various lids to and from the test pan 110, as further detailed in the examples of FIGS. 10 and 11.

Figure 7:
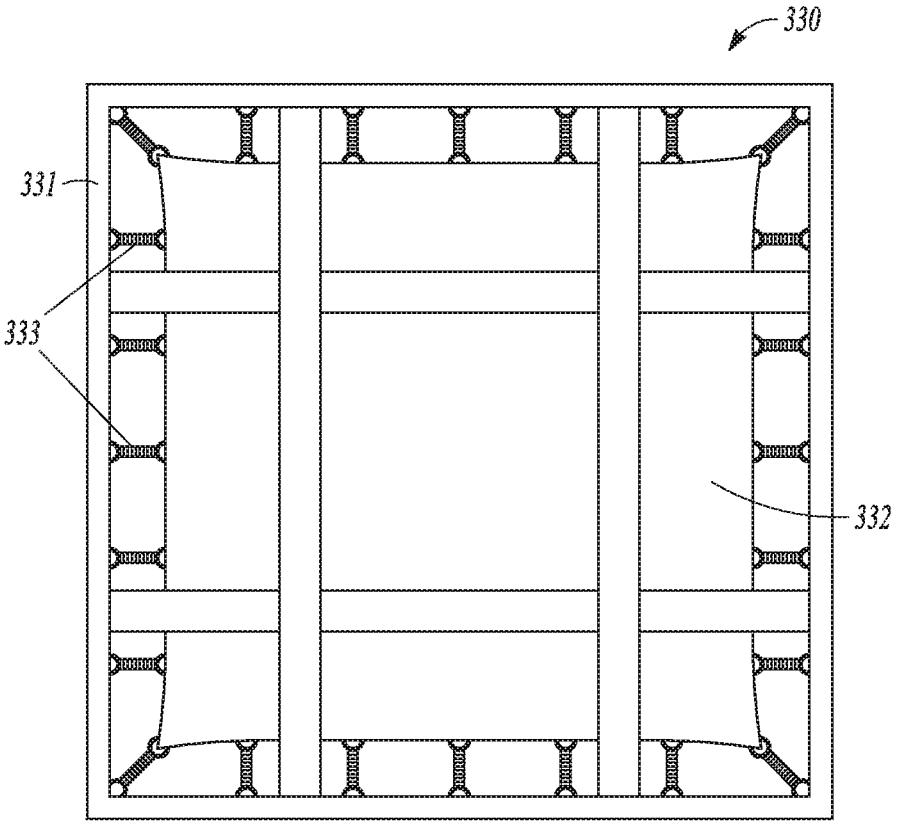
FIG. 7 illustrates generally a top view of a third lid.
Figure 8:
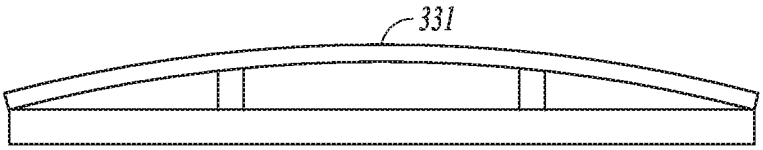
FIG. 8 illustrates generally a side view of a frame for the third lid.
Figure 9:
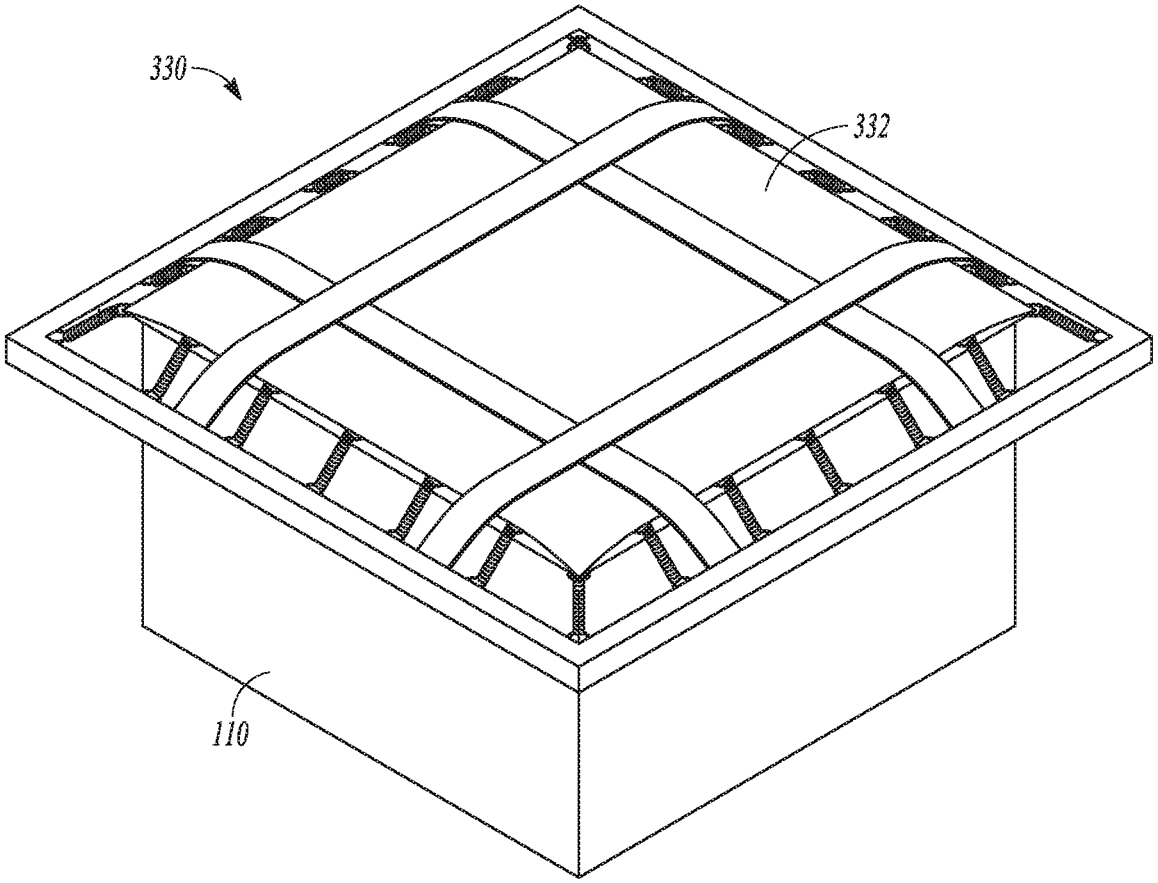
FIG. 9 illustrates generally a perspective view of a flammable liquid test pan covered by the third lid.

FIG. 7 illustrates generally a top view of a third lid 330. FIG. 8 illustrates generally a side view of a frame for the third lid 330. FIG. 9 illustrates generally perspective view of the flammable liquid test pan 110 covered by the third lid 330. As shown in the example of FIG. 9, when the third lid 330 mates with an upper edge surface of the sidewalls of the test pan 110, the flexible material of the third lid 330 conforms to the perimeter edge of the test pan thereby creating a substantially airtight, impermeable seal that deprives an interior volume of oxygen and extinguishes any fire contained therein.

In the example of FIGS. 7 and 8, the third lid 330 includes a lid frame 331 that can be constructed using, for example, aluminum or steel tubing or rods. Various support members can be provided over the surface area enclosed by the frame to enhance structural integrity of the lid frame 331 and the third lid 330. The support members extending between opposite sides of the lid frame 331 can be arched, as shown in the side view of FIG. 8. In an example, outer dimensions (e.g., an outer perimeter) of the third lid 330 are selected to be larger than corresponding outer dimensions of the test pan 110 so that the outer edges of the third lid 330 sit over the outer sidewalls of the test pan 110, as shown in FIG. 9.

The third lid 330 includes a fire blanket 332 that is secured to the lid frame 331 using multiple elastic suspension members, such as springs 333. In an example, the springs 333 are fire-resistant and heat-resistant coil springs made of steel or aluminum. In the example of FIG. 7, a first side of each of the springs 333 can attach to an outer perimeter edge of the fire blanket 332, and an opposite second side of each of the springs 333 can attach to an inner perimeter edge of the lid frame 331. The fire blanket 332 can optionally include a reinforcement member or rod that extends along its perimeter edge and to which the springs 333 can attach. In an example, the springs are about 4 to 6 inches long and about 1 inch in diameter, however, other springs can be used depending on the weight and durability of the fire blanket 332 and the lid frame 331. In an example, the springs 333 can be wrapped in an insulator material that is fire resistant and heat resistant, and can be covered with an aluminized fire protective material. In an example, the same material used for the fire blanket 332 can be used to wrap and protect the springs 333.

The surface area of the fire blanket 332 can be slightly less than a surface area enclosed by the lid frame 331. For example, if 6-inch springs 333 are used, then the fire blanket 332 can be about 8 inches smaller than the lid frame 331 in each direction. Such dimensions can help maintain the springs 333 under tension and thereby maintain the fire blanket 332 in a substantially flattened or tensioned and taut state.

FIG. 9 shows the third lid 330 mated with the top edge 111 of the test pan 110 (in the example of FIG. 9, the top edge 111 is not visible through the fire blanket 332). The fire blanket 332 portion of the third lid 330 can wrap around and conform to the contours of the top edge 111 of the test pan 110 to provide an airtight seal. In an example, there can be sufficient tension in the fire blanket 332 and the springs 333 such that the lid frame 331 is suspended by the fire blanket 332 and its contact with the test pan 110. In another example, crossbar support members of the lid frame 331 contact the top edge 111 of the test pan 110 and support the third lid 330.

In some examples, the third lid 330 can be manually positioned over the test pan 110 by test personnel who can carry the third lid 330 and adjust its position by hand. In other examples, various rigging systems can suspend the third lid 330, such as using cables and pulleys, and can be used to maneuver and position the lid over the test pan 110. In still other examples, various vehicles can be configured to carry the third lid 330, such as between a first location distal to the test pan 110 and a second location at or adjacent to the test pan 110. In an example, a vehicle configured to carry the third lid 330 can be configured to raise or lower the third lid 330 relative to the ground. For example, the vehicle can be configured to carry the third lid 330 in an elevated position, and can further be configured to straddle the test pan 110 such that the vehicle can move the third lid 330 into position above the test pan 110 and then lower the third lid 330 atop the test pan 110.

Figure 10:
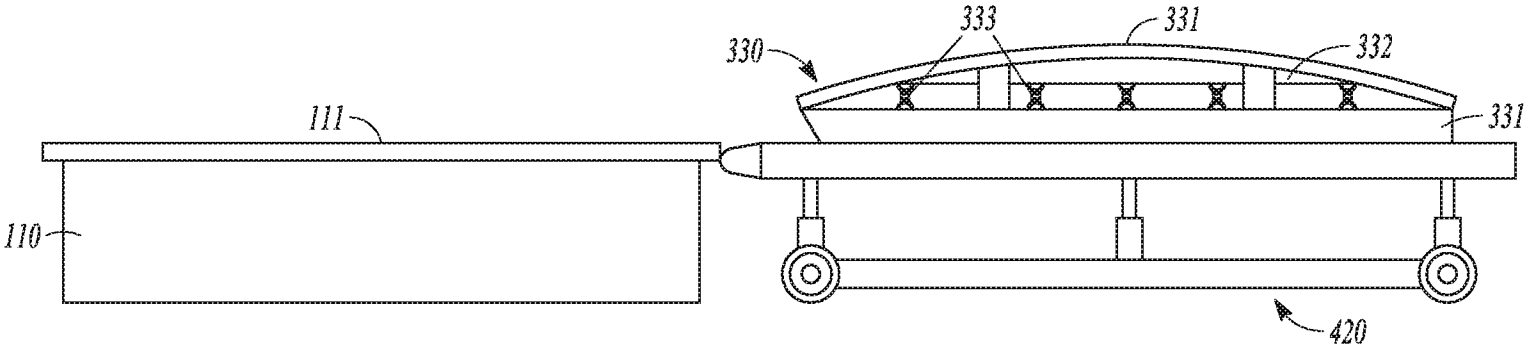
FIG. 10 illustrates generally an example of the third lid carried by a fourth vehicle in an elevated position.

FIG. 10 illustrates generally an example of the third lid 330 being carried by a fourth vehicle 420 in an elevated position. In the elevated position, a bottom portion of the lid frame 331 of the third lid 330 is at or above the top edge 111 of the test pan 110. The fourth vehicle 420 can travel up to and around at least a portion of the test pan 110 to place the third lid 330 in position over the test pan 110.

Figure 11:
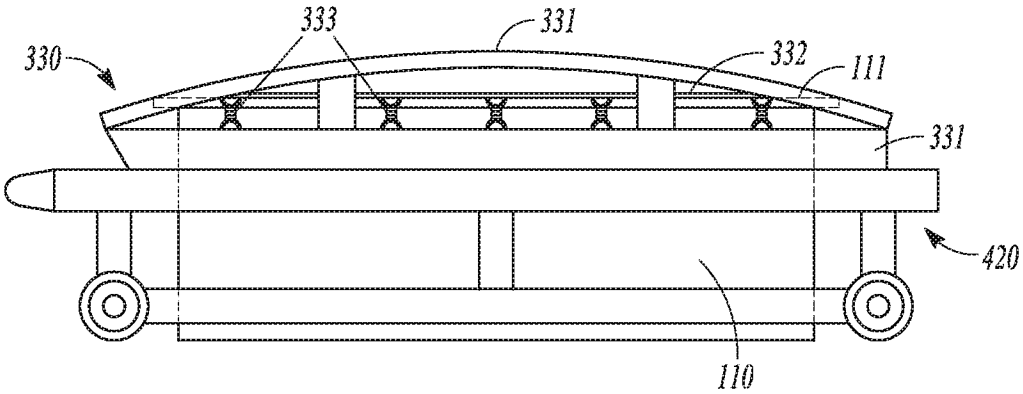
FIG. 11 illustrates generally an example of the fourth vehicle in a lowered position and the third lid seated on a test pan.

FIG. 11 illustrates generally an example of the fourth vehicle 420 in a lowered position. The fourth vehicle 420 can be lowered after the vehicle is positioned such that it straddles at least a portion of the test pan 110. When the fourth vehicle 420 is lowered, the third lid 330 is lowered into position above the test pan 110 and a lower surface of the fire blanket 332 mates with the top edge 111 of the test pan 110. The springs 333 can extend under the weight of the third lid 330 as the fire blanket 332 is drawn taught over the top edge 111 under the weight of the third lid 330 itself.

Figure 12:
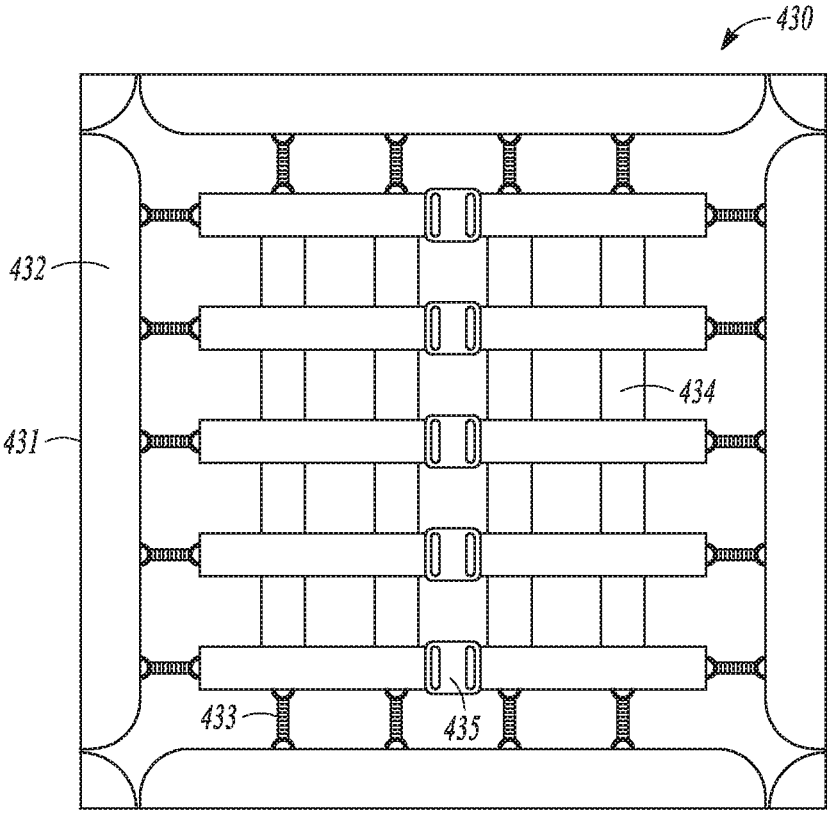
FIG. 12 illustrates generally a top view of a fourth lid.
Figure 13:
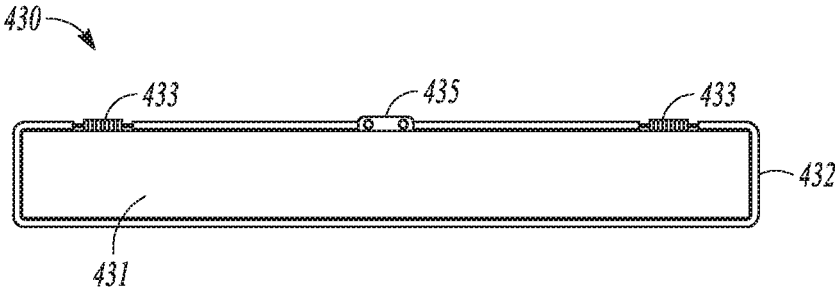
FIG. 13 illustrates generally a cross-section view of the fourth lid.

FIG. 12 illustrates generally a top view of a fourth lid 430. FIG. 13 illustrates generally a cross-section view of the fourth lid 430. The fourth lid 430 includes a fire blanket 432 under tension from elastic suspension members, or springs 433, similarly to the third lid 330. However, in the example of the fourth lid 430, the fire blanket 432 is wrapped around a perimeter edge of a frame system 431 such that each of the springs 433 is on a top surface of the fourth lid 430 and thus not directly exposed to heat or fire from the test pan 110. That is, in the example of the fourth lid 430, the springs 433 are coupled to the fire blanket 432 rather than to a perimeter portion of the frame system 431.

In the example of the fourth lid 430, the frame system 431 includes a central cross member. The cross member can be configured such that it does not interfere with a flat surface of the underside of the fire blanket 432. In this example, and in contrast to the third lid 330, the fire blanket 432 extends beyond an outer perimeter edge of the frame system 431. Thus the fire blanket 432 wraps over the frame, and the springs 433 are provided on a side opposite from a test fire in the test pan 110.

In the example of FIGS. 12 and 13, a turnbuckle 435 or other tensioning mechanism can be provided to adjust tension in the fire blanket 432, such as to maintain the fire blanket 432 in a tensioned or taut state. For example, the turnbuckle 435 can be coupled to the springs 433 and to one or more cinching cables 434. The turnbuckle can be used to adjust a length of the one or more cinching cables 434, thereby tensioning or relaxing the fire blanket 432. The turnbuckle 435 can provide distributed tension adjustments so the fire blanket 432 lays substantially flat against the top edge 111 of the test pan 110. In an example, multiple turnbuckles can be provided to adjust tension in different portions of the fire blanket 432.

VARIOUS NOTES AND ASPECTS

Aspect 1 can include or use subject matter (such as an apparatus, a system, a device, a method, a means for performing acts such as operating the apparatus, system, or device, or a device readable, non-transitory medium including instructions that, when performed by the device, can cause the device to perform such acts), such as can include or use a fire extinguishing system for use with a flammable liquid test pan, the system comprising a test pan lid including a substantially impermeable portion configured to mate with a top surface of sidewalls of the test pan, wherein when the test pan lid is mated with the top surface of the sidewalls of the test pan, an enclosed volume of the test pan is deprived of ambient combustible gas, and a vehicle configured to carry the test pan lid from a first vehicle location that is distal to the test pan to a second vehicle location that is adjacent to the test pan, the vehicle including a lid transfer device that facilitates motion of the test pan lid relative to the vehicle to transfer the test pan lid from the vehicle to the top surface of the test pan.

Aspect 2 can include or use, or can optionally be combined with the subject matter of Aspect 1, to optionally include the substantially impermeable portion of the test pan lid includes a substantially planar sheet of fire-proof or fire-resistant material.

Aspect 3 can include or use, or can optionally be combined with the subject matter of one or any combination of Aspects 1 or 2 to optionally include the substantially impermeable portion of the test pan lid includes a gas inlet configured to receive and transport an inert gas or a fire-suppressant gas from a first outer side of the lid to an opposite second side of the lid when the lid is mated with the top surface of the sidewalls of the test pan.

Aspect 4 can include or use, or can optionally be combined with the subject matter of one or any combination of Aspects 1 through 3 to optionally include or use the substantially impermeable portion of the test pan lid includes a reclosable port configured to receive a fire extinguishing agent from a dispenser external to the test pan and external to the lid.

Aspect 5 can include or use, or can optionally be combined with the subject matter of one or any combination of Aspects 1 through 4 to optionally include or use the substantially impermeable portion of the test pan lid is a flexible fire blanket comprising one or more of fiberglass, wool, and aramid fiber.

Aspect 6 can include or use, or can optionally be combined with the subject matter of one or any combination of Aspects 1 through 5 to optionally include or use a fire-resistant cable, coupled to the test pan lid, the cable configured to be pulled by a user to further facilitate transferring the lid from the vehicle to the top surface of the sidewalk of the test pan.

Aspect 7 can include or use, or can optionally be combined with the subject matter of one or any combination of Aspects 1 through 6 to optionally include or use the substantially impermeable portion of the test pan lid includes a push plate configured to receive a push rod, wherein the push rod is configured to be pushed by a user into the push plate to further facilitate transferring the lid from the vehicle to the top surface of sidewalls of the test pan.

Aspect 8 can include or use, or can optionally be combined with the subject matter of one or any combination of Aspects 1 through 7 to optionally include or use, at a first surface of the lid, a substantially airtight container except for a port that provides liquid or gas communication between the container and an opposite side of the lid.

Aspect 9 can include or use, or can optionally be combined with the subject matter of Aspect 8, to optionally include dry ice provided in the container.

Aspect 10 can include or use, or can optionally be combined with the subject matter of one or any combination of Aspects 1 through 9 to optionally include or use the substantially impermeable portion of the test pan lid includes a leading edge that is configured to contact a top or side edge of the test pan when the vehicle is at the second location adjacent to the test pan, and wherein the leading edge is rounded or chamfered.

Aspect 11 can include or use, or can optionally be combined with the subject matter of one or any combination of Aspects 1 through 10 to optionally include or use the vehicle including a wheeled cart having at least three wheels.

Aspect 12 can include or use, or can optionally be combined with the subject matter of one or any combination of Aspects 1 through 11 to optionally include or use the vehicle including a sleigh having at least two runners.

Aspect 13 can include or use, or can optionally be combined with the subject matter of one or any combination of Aspects 1 through 12 to optionally include or use a track extending between the first and second vehicle locations, wherein the vehicle is configured to travel upon the track.

Aspect 14 can include or use, or can optionally be combined with the subject matter of one or any combination of Aspects 1 through 13 to optionally include or use the vehicle including a bumper arranged at a leading edge of the vehicle when the vehicle travels toward the test pan, wherein the bumper is configured to contact a side edge of the test pan before the lid is transferred to the test pan.

Aspect 15 can include or use, or can optionally be combined with the subject matter of one or any combination of Aspects 1 through 14 to optionally include or use the lid transfer device including at least one roller having a roller surface that contacts an underside of the lid.

Aspect 16 can include or use, or can optionally be combined with the subject matter of one or any combination of Aspects 1 through 15 to optionally include or use the lid transfer device including at least two runners having respective runner surfaces that contact an underside of the lid.

Aspect 17 can include or use subject matter (such as an apparatus, a system, a device, a method, a means for performing acts such as operating the apparatus, system, or device, or a device readable, non-transitory medium including instructions that, when performed by the device, can cause the device to perform such acts), such as can include or use a vehicle for use in a fire extinguisher test environment to carry materials or equipment between a fire test pan location and a remote location when a fire test is conducted, the vehicle comprising a horizontal, upper vehicle surface configured to receive a test pan lid, and a lid transfer device configured to aid in transferring the test pan lid from the upper vehicle surface to an upper surface of sidewalls of the fire test pan when the vehicle is near or adjacent to the fire test pan.

Aspect 18 can include or use, or can optionally be combined with the subject matter of Aspect 17, to optionally include the vehicle configured to include or travel upon at least one of a wheel system or runner system.

Aspect 19 can include or use, or can optionally be combined with the subject matter of one or any combination of Aspects 17 or 18 to optionally include the lid transfer device including one or more cylindrical rollers configured to engage with a lower surface of the fire test pan lid.

Aspect 20 can include or use, or can optionally be combined with the subject matter of one or any combination of Aspects 17 through 19 to optionally include or use the lid transfer device including one or more runners or rails configured to engage with a lower surface of the fire test pan lid.

Aspect 21 can include or use, or can optionally be combined with the subject matter of one or any combination of Aspects 17 through 20 to optionally include or use a fire-resistant frame that couples the upper vehicle surface and the lid transfer device, wherein a total surface area characteristic of fire test pan lid exceeds an upper surface area characteristic of the vehicle.

Aspect 22 can include or use, or can optionally be combined with the subject matter of one or any combination of Aspects 17 through 21 to optionally include or use a bumper arranged at a leading edge of the vehicle when the vehicle travels toward the fire test pan, wherein the bumper is configured to contact a side edge of the fire test pan before the test pan lid is transferred to the test pan.

Aspect 23 can include or use subject matter (such as an apparatus, a system, a device, a method, a means for performing acts such as operating the apparatus, system, or device, or a device readable, non-transitory medium including instructions that, when performed by the device, can cause the device to perform such acts), such as can include or use a method for extinguishing a test fire in a flammable liquid test pan, the method comprising using a lid transport vehicle, transporting a test pan lid from a first location that is distal to the test pan to a second location that is adjacent to the test pan, and when the vehicle is positioned at the second location, transferring the test pan lid from the vehicle to the test pan, wherein the test pan lid is configured to mate with a top surface of sidewalls of the test pan and thereby deprive an enclosed volume of the test pan of combustible gas.

Aspect 24 can include or use or can optionally be combined with the subject matter of Aspect 23, to optionally include the transferring the test pan lid from the vehicle to the test pan includes horizontally sliding the lid from a top surface of the vehicle to the top surface of the test pan using cylindrical rollers coupled to the vehicle.

Aspect 25 can include or use or can optionally be combined with the subject matter of one or any combination of Aspects 23 or 24 to optionally include providing a supplementary extinguisher material to the enclosed volume of the test pan via a port in the test pan lid.

Aspect 26 can include or use, or can optionally be combined with the subject matter of one or any combination of Aspects 23 through 25 to optionally include or use transferring the test pan lid includes using a fire-resistant cable coupled to the test pan lid to exert a pull force on the lid, the force being sufficient to overcome friction between the test pan lid and the vehicle and/or to overcome friction between the test pan lid and the top surface of the sidewalls of the test pan.

Aspect 27 can include or use subject matter (such as an apparatus, a system, a device, a method, a means for performing acts such as operating the apparatus, system, or device, or a device readable, non-transitory medium including instructions that, when performed by the device, can cause the device to perform such acts), such as can include or use a fire extinguishing lid for use with a flammable liquid test pan, the lid comprising a frame portion, a flexible fire blanket, and an elastic suspension member coupled to a perimeter edge of the flexible fire blanket, the elastic suspension member configured to suspend and tension the flexible fire blanket, and wherein the frame is coupled to at least one of the elastic suspension member and a surface of the flexible fire blanket.

Aspect 28 can include or use, or can optionally be combined with the subject matter of Aspect 27, to optionally include a plurality of elastic suspension members, wherein the members are coupled to the frame portion and to the perimeter edge of the flexible fire blanket.

Aspect 29 can include or use, or can optionally be combined with the subject matter of one or any combination of Aspects 27 or 28 to optionally include the elastic suspension member coupled to opposite edges of the flexible fire blanket, and the flexible fire blanket wraps substantially around opposite sides of the frame portion.

Aspect 30 can include or use, or can optionally be combined with the subject matter of one or any combination of Aspects 27 through 29 to optionally include or use a tensioning mechanism configured to adjust at least one of an elasticity characteristic of the elastic suspension member or to adjust a tension of flexible fire blanket.

Aspect 31 can include or use, or can optionally be combined with the subject matter of one or any combination of Aspects 27 through 30 to optionally include or use the elastic suspension member includes a fire-resistant and heat-resistant coil spring.

Aspect 32 can include or use, or can optionally be combined with the subject matter of one or any combination of Aspects 27 through 31 to optionally include or use the flexible fire blanket comprises one or more of fiberglass, wool, and aramid fiber.

Aspect 33 can include or use, or can optionally be combined with the subject matter of one or any combination of Aspects 27 through 32 to optionally include or use a reclosable port configured to receive a fire extinguishing agent from a dispenser external to the test pan and external to the lid.

Aspect 34 can include or use, or can optionally be combined with the subject matter of one or any combination of Aspects 27 through 33 to optionally include or use the frame portion including a fire-resistant and heat-resistant rigid frame having an outer perimeter that is larger than an outer perimeter of the flammable liquid test pan.

Each of these non-limiting Aspects can stand on its own, or can be combined in various permutations or combinations with one or more of the other Aspects or examples provided herein.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b) to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A fire extinguishing system for use with a flammable liquid test pan, the system comprising:

a test pan lid including a rigid impermeable portion configured to mate with a top surface of sidewalls of the test pan, wherein when the rigid impermeable portion of the test pan lid is mated with the top surface of the sidewalls of the test pan, an enclosed volume of the test pan is deprived of ambient combustible gas; and a vehicle configured to carry the test pan lid from a first vehicle location that is distal to the test pan to a second vehicle location that is adjacent to the test pan, the vehicle including a lid transfer device that facilitates a sliding motion between the rigid impermeable portion of the test pan lid and the transfer device relative to the vehicle to transfer the test pan lid from a first position on the vehicle to a second position on the top surface of the test pan, the vehicle comprising a frame constructed of a durable, heat and flame resistant material.

2. The system of claim 1, wherein the rigid impermeable portion of the test pan lid includes a substantially planar sheet of fire-proof or fire-resistant material.

3. The system of claim 1, wherein the rigid impermeable portion of the test pan lid includes a gas inlet configured to receive and transport an inert gas or a fire-suppressant gas from a first outer side of the lid to an opposite second side of the lid when the rigid impermeable portion of the lid is mated with the top surface of the sidewalls of the test pan.

4. The system of claim 1, wherein the rigid impermeable portion of the test pan lid includes a reclosable port configured to receive a fire extinguishing agent from a dispenser external to the test pan and external to the lid.

5. The system of claim 1, further comprising a fire-resistant cable, coupled to the test pan lid, the cable configured to be pulled by a user to further facilitate transferring the lid from the vehicle to the top surface of the sidewalls of the test pan.

6. The system of claim 1, wherein the rigid impermeable portion of the test pan lid includes a push plate configured to receive a push rod, wherein the push rod is configured to be pushed by a user into the push plate to further facilitate transferring the lid from the vehicle to the top surface of sidewalls of the test pan.

7. The system of claim 1, wherein a first surface of the lid includes a substantially airtight container except for a port that provides liquid or gas communication between the container and an opposite side of the lid.

8. The system of claim 1, wherein the rigid impermeable portion of the test pan lid includes a leading edge that is configured to contact a top or side edge of the test pan when the vehicle is at the second location adjacent to the test pan, and wherein the leading edge is rounded or chamfered.

9. The system of claim 1, wherein the vehicle includes a wheeled cart having at least three wheels.

10. The system of claim 1, wherein the vehicle includes a bumper arranged at a leading edge of the vehicle when the vehicle travels toward the test pan, wherein the bumper is configured to contact a side edge of the test pan before the lid is transferred to the test pan.

11. The system of claim 1, wherein the lid transfer device includes at least one roller having a roller surface that contacts an underside of the lid.

12. A system for use in a fire extinguisher test environment when a fire test is conducted, the system comprising:

a test pan lid including a rigid impermeable portion configured to mate with a top surface of a flammable material test pan, wherein when the rigid impermeable portion of the test pan lid is mated with the top surface of the test pan, an enclosed volume of the test pan is deprived of ambient combustible gas; and a vehicle to carry materials or equipment between the test pan and a remote location, the vehicle comprising:

an upper vehicle surface configured to receive the test pan lid; and a lid transfer device configured to aid in transferring the rigid impermeable portion of the test pan lid from a first position on the upper vehicle surface to a second position on an upper surface of sidewalls of the test pan via a sliding motion between the rigid impermeable portion of the test pan lid and the lid transfer device when the vehicle is near or adjacent to the test pan.

13. The vehicle of claim 12, wherein the lid transfer device includes one or more cylindrical rollers configured to engage with a lower surface of the test pan lid.

14. The vehicle of claim 12, wherein the lid transfer device includes one or more runners or rails configured to engage with a lower surface of the test pan lid.

15. The vehicle of claim 12, further comprising a fire-resistant frame that couples the upper vehicle surface and the lid transfer device, wherein a total surface area characteristic of test pan lid exceeds an upper surface area characteristic of the vehicle.

16. The vehicle of claim 12, further comprising a bumper arranged at a leading edge of the vehicle when the vehicle travels toward the test pan, wherein the bumper is configured to contact a side edge of the test pan before the test pan lid is transferred to the test pan.

* * * * *